United States Patent [19]

Unterstrasser et al.

[11] Patent Number: 4,863,359

[45] Date of Patent: Sep. 5, 1989

[54] STATOR FOR ECCENTRIC WORM PUMPS

[75] Inventors: Eugen Unterstrasser, Aschau/Inn; Johann Kreidl, Waldkraiburg, both of Fed. Rep. of Germany

[73] Assignee: Netzsch-Mohnopumpen GmbH, Waldkraiburg, Fed. Rep. of Germany

[21] Appl. No.: 885,639

[22] Filed: Jul. 15, 1986

[30] Foreign Application Priority Data

Jul. 17, 1985 [DE] Fed. Rep. of Germany ..... 3525529

[51] Int. Cl.[4] ..... F04C 2/107; F04C 5/00

[52] U.S. Cl. ..... 418/48; 418/153; 418/178

[58] Field of Search ..... 418/48, 153, 156, 178, 418/182; 175/107

[56] References Cited

U.S. PATENT DOCUMENTS 4,676,725 6/1987 Eppink ..... 418/48

FOREIGN PATENT DOCUMENTS 2017620 11/1971 Fed. Rep. of Germany .
2408186 8/1975 Fed. Rep. of Germany .
2709502 9/1977 Fed. Rep. of Germany .
2817280 10/1979 Fed. Rep. of Germany .

OTHER PUBLICATIONS

"Wirkungsweise von Exzenterscheckenpumpen", by Messrs. Bornemann Pumpen of D-3063 Obernkirchen.

*Primary Examiner*—John J. Vrablik
*Attorney, Agent, or Firm*—Kenyon & Kenyon

[57] ABSTRACT

The stator comprises a rigid tubular casing and an elastic lining which is tightly enclosed by the casing and symmetrical with respect to the longitudinal center axis of the stator. The inner surface of the lining forms a multiple thread and, in cross section, consists of a number of sections near the axis equal to the number of courses of the thread and an equally great number of concave arcs. The lining has a minimum thickness each at the concave arcs and a maximum thickness each near at least two of the transitions between the sections near the axis and the concave arcs.

2 Claims, 2 Drawing Sheets

STATOR FOR ECCENTRIC WORM PUMPS

Figure 1:
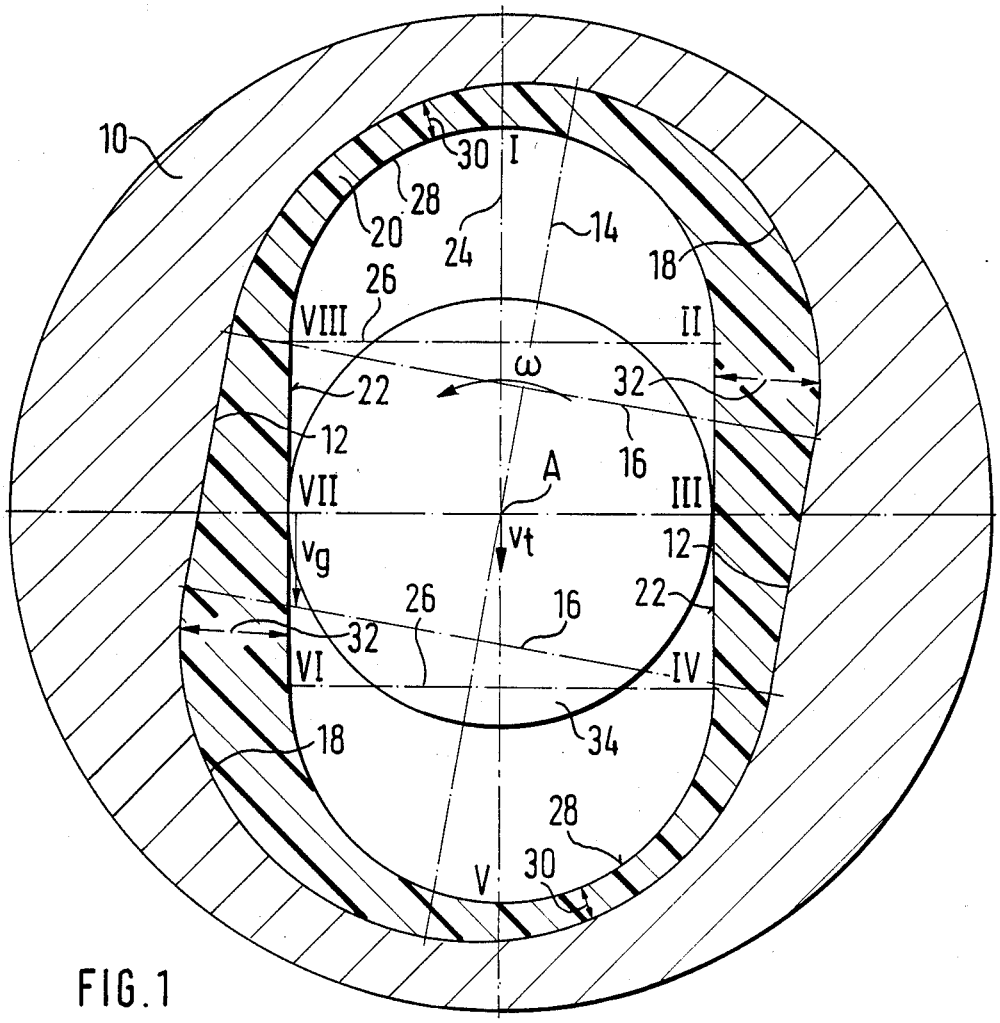

The instant invention relates to a stator for eccentric worm pumps, comprising a rigid tubular casing the inner surface of which forms a multiple thread, and further comprising an elastic lining which lies against the casing throughout the axial length thereof, is symmetrical with respect to the longitudinal center axis of the stator, and has an inner surface which likewise forms a multiple thread and in cross section consists of a number of sections near the axis equalling the number of courses of the thread and an equally great number of concave arcs bordering on the sections near the axis by continuous transitions, the lining having a minimum thickness each at the concave arcs. In the case of a known stator (German patent No. 20 17 620) which presents an early stage of this type of stator the rigid tubular casing is of circular cylindrical shape both inside and outside and thus also the outer surface of the lining is of circular cylindrical configuration. The inner surface of the lining is of double threaded design and has a substantially oval cross section, including two sections near the axis and two semicircular arcs interconnecting the sections near the axis. The two sections near the axis are slightly convex, in other words curved toward the longitudinal center axis of the stator. This is to provide better sealing between the stator and a rotor of circular cross section and formed with a single helical thread. It proved to be disadvantageous that the particularly thick regions of the elastic lining constituting the sections thereof near the axis tend to become more deformed by the pressure of a medium being conveyed in practice and are less well suited to dissipate heat due to energy losses to the tubular casing than are the thin regions of the lining.

For this reason the inner surface of the rigid tubular casing and the outer surface of the elastic lining of another known stator (German patent No. 27 09 502) of the kind specified initially have a configuration corresponding approximately to the double helically threaded inner surface of the lining. However, the sections near the axis of the inner surface of the lining where the highest sliding speeds occur of the associated rotor again comprise elevations which are convexly curved inwardly, and the lining includes also radially outwardly projecting elevations at these sections near the axis. The thickness of the latter is greater than the thickness of the inner elevations in an order of magnitude of a power of ten. The outer elevations of the lining are received in corresponding cavities provided at the inside of the rigid tubular casing. This is intended to provide more uniform clamping of the rotor in the stator and a higher degree of efficiency while, at the same time, affording a longer service life.

Another known stator (German patent application laid open DE-OS 28 17 280) includes an elastic lining the inner wall of which likewise is formed with a double helical thread and the outer wall of which approximates a corresponding double helical thread but is divided into a plurality of axially adjacent sections each of which corresponds in axial extension to one eighth of a full helix and each of which forms a cylinder surface of oval cross section. If such a stator section is cut in a plane normal to the longitudinal center axis of the stator and lying in the middle of the respective section, the rectilinear portions of its oval outer surface extend parallel to the rectilinear portions of the inner surface. On the other hand, if such a stator section is cut in a plane which is normal to the longitudinal center axis of the stator but spaced from the center plane mentioned, then the oval of the outer contour of such a cut is staggered with respect to the oval of the inner contour thereof in one or the other direction about the longitudinal center axis, depending on the side of the center plane normal to the axis of the respective stator section at which the plane of the cut is positioned. Two diametrically opposed tangential grooves extending parallel to the rectilinear sections near the axis of the inner surface are formed from the outside in each of those stator sections in the center plane. The tangential grooves define free spaces which reduce the force of engagement between the sections near the axis of the inner wall of the elastic lining and the corresponding rotor, whereby friction is diminished.

It is known as well (publication entitled "Wirkungsweise von Exzenterschneckenpumpen" by Messrs. Bornemann Pumpen of D-3063 Obernkirchen) that in operation the lining forms bulges in regions of maximum sliding speeds of the rotor which bulges precede the rotor. This is so because of the elastic bias under which the lining envelopes the rotor to establish the necessary sealing between the rotor and the stator and also because of the relative movement betwen rotor and stator. The rotor overruns the respective bulges to the extent that it penetrates one of the concave arcs of the lining. Subsequent to that, new bulges are formed which are advancing ahead of the rotor as it is leaving the concave arc.

The invention is based on the finding that a major share of the wear which the lining suffers is related to the steady repetitions of the forming and overrunning of these bulges.

It is, therefore, an object of the instant invention to reduce this type of wear and the imperfect sealing it leads to.

This object is met, in accordance with the invention, with a stator of the kind specified initially in that the thickness of the lining increases continuously in the respective direction in which the rotational and translational motions add of the associated rotor, at least from the middle of the section near the axis up to a maximum thickness at the transition into the concave arc, and decreases continuously down to a minimum thickness in the area of the concave arc.

The maximum values of the thickness, in accordance with the invention, thus no longer lie in the central area of each of the sections near the axis where the sliding speed of the rotor reaches its maximum. Instead, the maximum values of thickness of the lining are shifted to the edges of the sections near the axis or even into the areas where the adjacent concave arcs begin. As a result, the thickness of the lining in the middle of each of its sections near the axis has a value which is less than the maximum thickness. In this manner the bead which has formed in front of the rotor is overrun more easily than with known stators of the same generic kind, as the rotor enters into one of the concave arcs of the inner surface. This protects the lining.

In a particular embodiment of the invention the inner surface of the casing and the inner surface of the lining are geometrically similar but staggered with respect to each other by 5° to 15° around the longitudinal center axis. In this case the lining has a maximum value of thickness at one end only of each section near the axis.

Therefore, the rotor is permitted to turn in a certain direction only in order to be able to overrun the bulge of the lining building up in front of the rotor at the respective maximum thickness. However, it is not unusual with eccentric worm type pumps to fix a certain direction of rotation, and this does not restrict their field of application.

Cases in which a determination of a certain direction of rotation is to be avoided are accommodated by another embodiment of the invention with which the thickness of the lining has a minimum value each in the middle of its concave arcs and another minimum value in the middle of each section near the axis. In this manner care is taken that the bulge of the lining forming in front of the rotor will be displaced by the rotor as it enters into one of the concave arcs, no matter what its sense of rotation. This avoids unnecessary squeezing action and heat-up.

This embodiment of the invention may be developed further in that the additional minimum values of thickness of the lining are not greater than the minimum values in the middle of the concave arcs.

Two embodiments of the invention will be described further below with reference to a diagrammatic drawing each.

Figure 2:
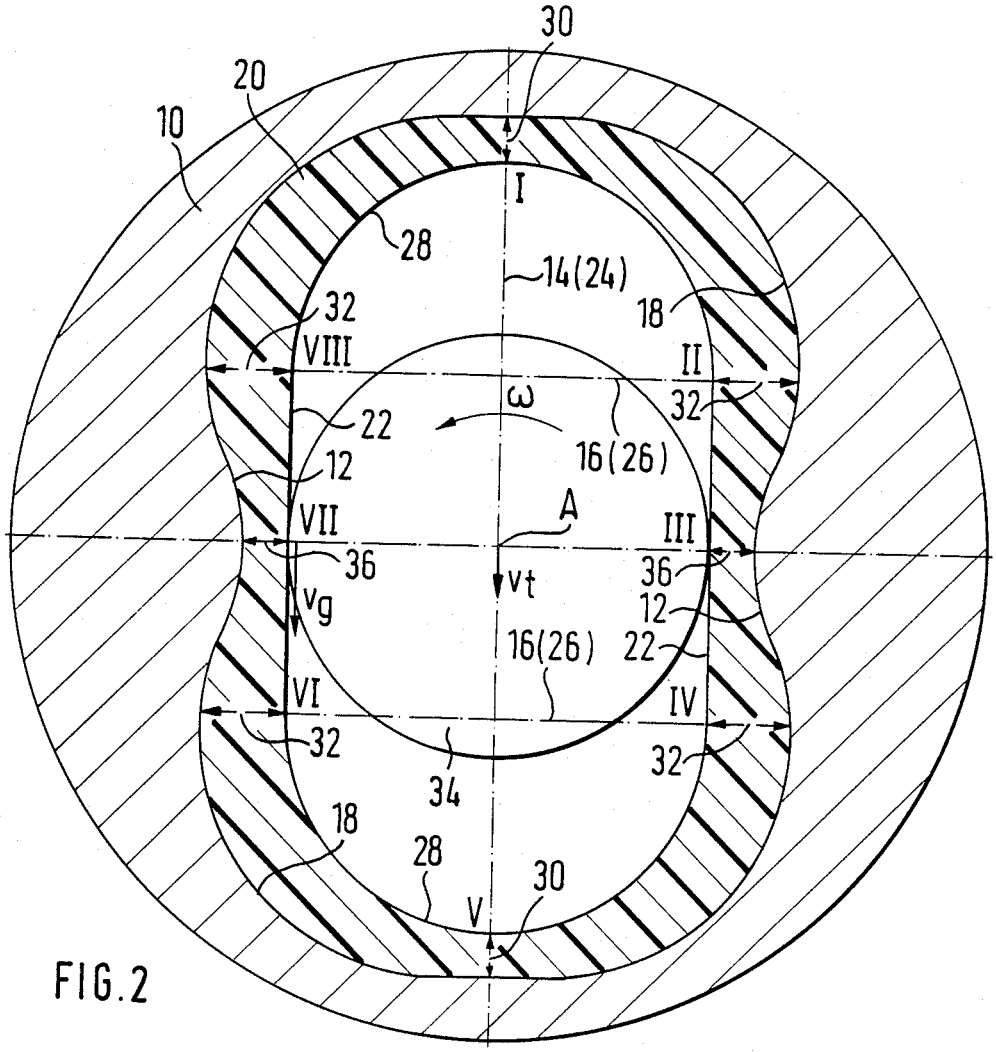

FIGS. 1 and 2 are axial sections of a respective eccentric worm pump.

FIG. 1 shows a tubular casing 10 made of rigid material, such as cast steel or aluminum. The casing 10 is symmetrical, in general, with respect to a longitudinal center axis A. Its outside is cylindrical and it has an inner surface formed with a double helical thread so it is oval in any desired cross section. The inner surface comprises two straight sections 12 near the axis which sections extend parallel to a main axis 14 between two transverse axes 16 and are interconnected by semicircular arcs 18.

The casing 10 encloses a lining 20 made of an elastomer and having an outer surface in continuous engagement with the inner surface 12,18 of the casing 10. This means that it is also formed with a double helix like the inner surface and, therefore, is oval in any cross section. The lining 20 has an inner surface which likewise is oval in any cross section and comprises two straight sections 22 near the axis which sections extend parallel to a main axis 24. The sections 22 near the axis also may be slightly convex. The main axis 24, like the main axis 14, intersects the longitudinal center axis A at right angles. Moreover, the main axes 14 and 24 intersect each other at an angle which is 10° in the case of the embodiment shown. The two straight sections 22 near the axis are limited by two transverse axes 26 and interconnected by two semicircular arcs 28. Each of the transverse axes 26 intersects the respective adjacent transverse axis 16 at an angle of 10° too.

In the cross section illustrated, as well as in any other cross section, the inner surface 22, 28 of the lining 20 has two apices I and V at which it is intersected by the main axis 24, and it also has four transitions II, IV, VI, and VIII at which it is intersected by the transverse axes 26. The sections 22 near the axis extend between the transitions II and IV as well as VI and VIII and each have a center III and VII, respectively. The concave arcs 28 extend between the transitions VIII and II as well as IV and VI and each have as their center one of the apices I and V, respectively.

The outer and inner surfaces of the lining 20 are similar in geometry but, because of the staggering of the main axes 14 and 24, they define zones of different thickness. The lining 20 has two minimum values 30 of thickness located just before the apices I and V, as seen upon rotation in clockwise sense. It also has two maximum values 32 of thickness which are positioned just behind the transitions VI and II and between the transverse axes 16 and 26 each.

A single-thread rotor 34 of circular cross section is fitted under radial bias in the lining 20. The rotor 34 turns in the direction of the arrow shown, and its highest sliding speed $V_g$ occurs at point VII. This sliding speed $V_g$ is composed of the translation of the rotor 34 at speed $V_t$ and the rotation of the rotor about its own axis.

In the case of the embodiment shown in FIG. 2 the lining 20 has an inner surface 22, 28 formed with a double helical thread, in agreement with the one shown in FIG. 1. However, this inner surface 22, 28 is not staggered with respect to the inner surface likewise formed with a double helical thread of the casing 10 and it is not similar to the geometry thereof. The outer surface of the lining 20 is in continuous engagement with the inner surface of the casing 10 and that inner surface has two opposed convex sections 12 near the axis which sections follow an approximately sinusoidal course. It also has two concave arcs 18 which are approximately semicircular but somewhat flattened in the area of the main axis 14. The elastic lining 20 has two minimum values 30 of thickness located on the coincident main axes 14 and 24, four maximum values 32 of thickness located in pairs on the transverse axes 16 and 26 which also are coincident, plus two more minimum values 36 of thickness at the centers III and VII of the sections 22 near the axis.

With the cross sectional profile of the elastic lining 20 as illustrated in FIG. 2 it makes no difference whether the rotor 34 turns in the direction of the arrow shown or in opposite direction.

What is claimed is:

1. A stator for eccentric worm pumps, comprising:

a rigid tubular casing having an inner surface which forms a multiple thread, an elastic lining which lies against the casing throughout the axial length thereof, is symmetrical with respect to the longitudinal center axis of the stator, said elastic lining having an inner surface which forms a multiple thread and in cross-section includes a number of sections near the axis equalling the number of courses of the thread and an equal number of concave arcs bordering on the sections near the axis by continuous transitions, the lining having a minimum thickness each at the concave arcs, the thickness of the lining increases continuously in the respective direction in which the rotational and translational motions are in the same direction of an associated rotor, at least from about the middle of the section near the axis up to a maximum thickness at the transition into the concave arc, and decreases continuously down to a minimum thickness in the area of the concave arc; and the thickness of the lining having a minimum value each in the middle of its concave arcs and another minimum value in the middle of each section near the axis.

2. The stator as claimed in claim 1, wherein the additional minimum values of the thickness of the lining are not greater than the minimum values in the middle of the concave arcs.

* * * * *